US005628223A

United States Patent [19]

Denker

[11] Patent Number: 5,628,223

[45] Date of Patent: May 13, 1997

[54] ARRANGEMENT FOR SEALING WITHOUT CONTACT A GAP IN THE RUNOUT OF A ROLL

[75] Inventor: Wolfgang Denker, Freudenberg, Germany

[73] Assignee: SMS Schloemann-Siemag Aktiengesellschaft, Düsseldorf, Germany

[21] Appl. No.: 369,788

[22] Filed: Jan. 6, 1995

[30] Foreign Application Priority Data

Jan. 8, 1994 [DE] Germany ..... 44 00 423.0

[51] Int. Cl.[6] ..... B21B 28/00

[52] U.S. Cl. ..... 72/236; 72/39

[58] Field of Search ..... 72/39, 40, 201, 72/236, 365.2, 366.2

[56] References Cited

U.S. PATENT DOCUMENTS 5,081,857 1/1992 Matsui et al. ..... 72/236

*Primary Examiner*—Lowell A. Larson
*Assistant Examiner*—Thomas C. Schoeffler
*Attorney, Agent, or Firm*—Friedrich Kueffner

[57] ABSTRACT

An arrangement for sealing without contact a gap between a separating wall and a work roll in the runout of a roll stand includes at an end of the separating wall a separating element which is arranged so as to extend approximately tangentially relative to the surface of the work roll and at a relatively small distance from the surface of the work roll and from the surface of the rolled material. The separating element has at least one supply duct for compressed air connected to a compressed air source, wherein the supply duct has at an end thereof a slot-shaped nozzle which is located at a small distance from the roll surface and extends along the roll surface in the direction of the roll axis. The blowing-out direction of the slot-shaped nozzle and a line extending from the nozzle opening perpendicularly relative to the axis of the work roll include an angle of between 0° and 45°. The separating element has at the front side thereof an end portion which extends approximately tangentially relative to and at a small distance from the roll surface and a flow channel is formed between the end portion and the roll surface, wherein the width of the flow channel increases steadily away from the tip in the manner of an injector, and wherein the flow channel extends at least over the width of the rolled material parallel to the axis of the work roll.

10 Claims, 2 Drawing Sheets

ARRANGEMENT FOR SEALING WITHOUT CONTACT A GAP IN THE RUNOUT OF A ROLL

BACKGROUND OF THE INVENTION

1. Field of the Invention

The present invention relates to an arrangement for sealing without contact a gap between a separating means and a work roll in the runout of a roll stand.

2. Description of the Related Art

In the runout of rolling mills, the quality of a strip is decisively influenced by the dryness and cleanliness of the strip surface. At the present time, very different types of blowing-off means, separating means and/or drawing-off means and combinations thereof are used in actual practice. However, a satisfactory solution has not yet been found. The reason for this is that when blowing-off means are used, air is backed up closely following the last work roll which causes moisture in the form of drops and/or other particles to drop back onto the strip and, thus, to reduce the strip quality.

In order to overcome the resulting difficulties, combinations of blowing-off means and drawing-off means have already been used in the area of a rolling mill runout. However, these combinations have other disadvantages because, for example, such combinations are very complicated and expensive and, thus, not economical because of the large quantities of air which have to be conveyed under pressure or negative pressure. In addition, since they are designed for large quantities of air, they use up space which is urgently needed for other units. When, for overcoming this difficulty, blowing-off means or combinations of blowing-off means with drawing-off means are positioned further toward the runout, they lose their effectiveness with increasing distance and the moisture remains adhering to the strip.

SUMMARY OF THE INVENTION

Therefore, it is the primary object of the present invention to further develop an arrangement for sealing without contact a gap in the runout of a roll stand in such a way that a dry and clean strip can be produced while avoiding the above-described difficulties and technical limitations, wherein the following requirements are to be met:

1. The entire runout area of the strip must be separated or sealed above and below the strip relative to rolling oil which is present in the runout behind the roll gap;

2. Gaps between rotating, stationary or linearly moved components must be sealed or separated off without contact by means of a defined air flow; it is a recognized requirement that sealing means may not have contact with the rolls so as to produce a grinding action;

3. Any wet surfaces, particularly in reversing stands, must be quickly dried by means of a large quantity of dry air.

4. Any entrained liquid on the sides of the strip edges must be deflected immediately behind the roll gap because experience has shown that liquid drops (emulsion/rolling oil) can no longer be blown away by means of air after the strip speed has been reached.

In accordance with the present invention, for meeting the above-described object, an arrangement for sealing without contact a gap between a separating means and a work roll in the runout of a roll stand has the following features:

(a) The separating means includes at an end thereof a separating element which is arranged so as to extend approximately tangentially relative to the surface of the work roll and at a relatively small distance from the surface of the work roll and from the surface of the rolled material;

(b) The separating element has at least one supply duct for compressed air connected to a compressed air source, wherein the supply duct has at an end thereof a slot-shaped nozzle which is located at a small distance from the roll surface and extends along the roll surface in the direction of the roll axis;

(c) The blowing-out direction of the slot-shaped nozzle and a line extending from the nozzle opening perpendicularly relative to the axis of rotation of the work roll include an angle which is in the direction of rotation of the roll between 0° and 45°, preferably 30°;

(d) The separating element has at the front side thereof an end portion which extends approximately tangentially relative to and at a small distance from the roll surface, wherein the thickness of the end portion decreases toward the tip thereof, such that a flow channel is formed between the end portion and the roll surface, wherein the width of the flow channel increases steadily away from the tip in the manner of an injector, and wherein the flow channel extends at least over the width of the rolled material parallel to the axis of the work roll;

(e) The separating means includes either a separating wall or a pivoting frame having a lower cutout, the separating element being mounted on a carriage, further including a drive unit for linearly driving the carriage on a guide means through the lower cutout and for adjusting the distance between the separating element and the roll surface.

The arrangement according to the present invention makes it possible for the first time in a surprisingly effective and uncomplicated manner to seal off a long gap between separating means and work roll by means of an energy-rich flow which emerges from a slot-shaped nozzle. The operation is based on the effect of "Prandtl-Meyer corner flow". The configuration according to the present invention of the separating element at the end of the separating means with the end portion which becomes narrower toward the tip and the arrangement of the separating element relative to the work roll make it possible to form between the separating element and the roll an injector-like expanding flow cross-section. In this flow cross-section, a negative pressure is produced because of the effect of the unilaterally expanding, energy-rich nozzle jet. As a result, large quantities of air are drawn through the gap between the separating element and the roll which flow toward the wet area. Consequently, the quantity of backed-up air is significantly reduced and a defined flow is produced between the separating means and the rolled material, wherein wet air with droplets and other particles is drawn off in the area of the flow. In this manner, a combination of blowing-off means and drawing-off means is integrated into the separating means within a very small space, which effectively reinforces the drawing-off of mist as well as the blowing-off of the strip edges and which facilitates a quick drying of the dripping wet surface areas in the runout of a roll stand or reversing stand. The arrangement can be used above and below the rolled strip. The arrangement can be used at many locations in a rolling mill train with traveling strip or rotating rolls where it is necessary to separate different air spaces from each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
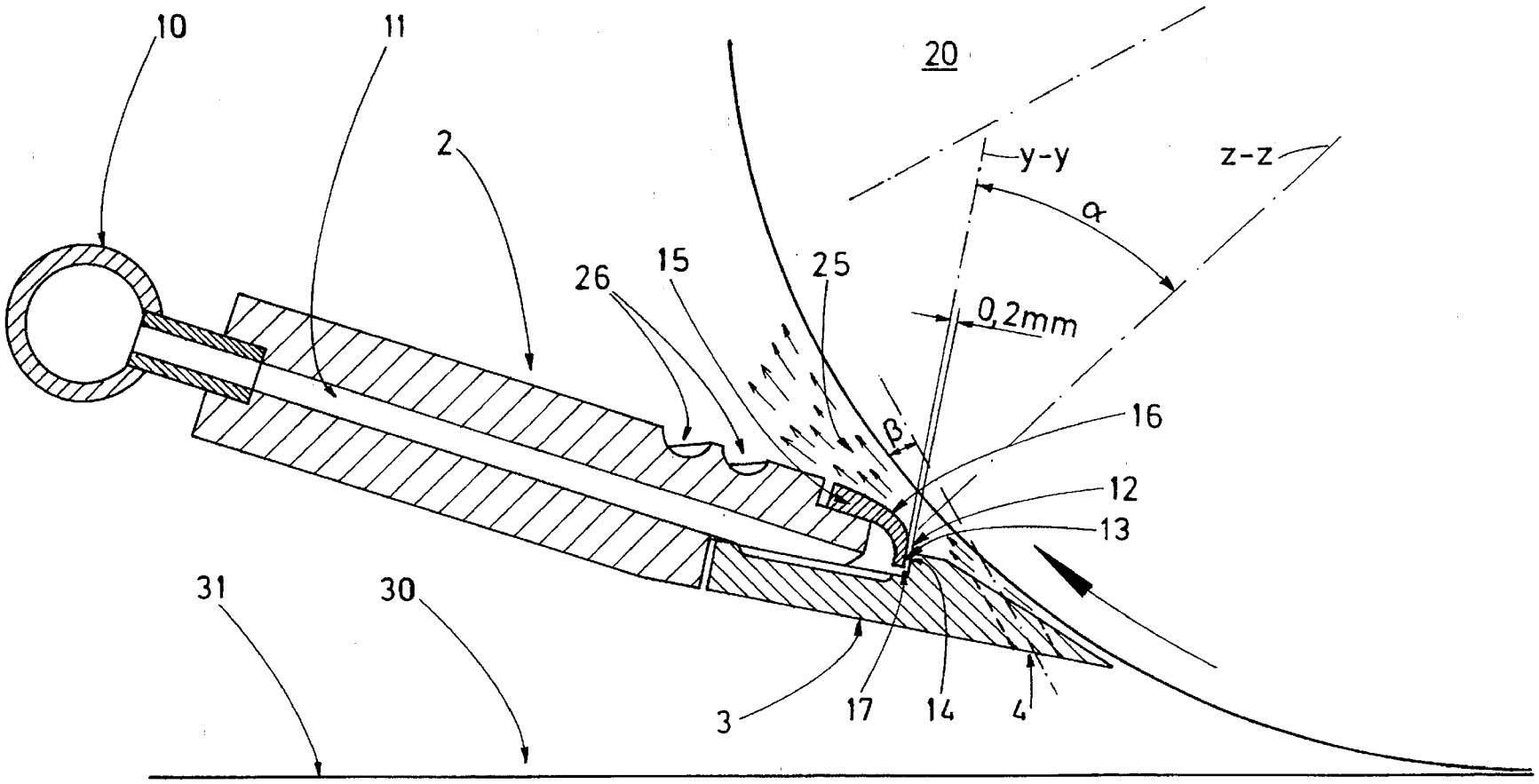
FIG. 1 is a schematic side view of a separating element of an arrangement according to the present invention.

FIG. 1 of the drawing shows a separating element 2 arranged at the end of a separating wall 1. The separating element 2 is a component of the arrangement which is illustrated in its entirety in FIG. 2.

The separating element 2 and its end portion 3 are arranged approximately tangentially relative to the surface of the work roll 20 and at a relatively small distance from the surface of the work roll 20 and the surface of the rolled material 30, so that a contact-free gap is formed between the separating element 2 and the work roll 20. The separating element 2 has at least one supply duct 11 for compressed air connected to a compressed air source 10.

The supply duct 11 ends in a slot-shaped nozzle 12 which extends at a small distance from and along the roll surface in the direction of the roll axis. Compressed air supplied at pressures of between 0.5 and 4 bar to the supply duct 11 is discharged from the slot-shaped nozzle 12 so as to form an air jet which is rich in energy and covers the width of the roll 20. The blowing-out direction y—y of the slot-shaped nozzle 12 and a line z—z extending from the nozzle opening 13 at a right angle relative to the axis of rotation of the work roll 20 include an angle $\alpha$ which is between 0° and 45°, preferably 30° in the direction of rotation of the roll 20. After being discharged from the slot-shaped nozzle 12, the air jet expands. The unilaterally expanded air jet which is deflected by the angle $\alpha$ produces a negative pressure in the steadily widening injector-like flow channel 25, wherein the drawing-off effect of the negative pressure draws up to 20 times the volume of the air jet discharged from the slot-shaped nozzle through the gap between the separating element 2 and the roll 20. In this manner, the gap between the separating element 2 and the work roll 20 can be effectively separated in the direction of the wet area by means of a defined air flow without causing air to be backed-up.

As can be seen in FIG. 1, an advantageous flow configuration of the air jet for forming a negative pressure in the flow channel 25 is achieved by forming the slot-shaped nozzle between a step 14 of the end portion 3 and an adjustable guide member 15 which determines the width of the nozzle gap 17. The width of the nozzle opening 12 can be adjusted to widths of between 0.1 mm and 4 mm, wherein the preferred width is 0.2 mm. The expansion of the nozzle jet is further reinforced by the fact that the guide member 12 has, seen in cross-section, a curved flow guide surface 16 extending rearwardly from the nozzle gap 17. This results in an impact-free, steady expansion of the jet which produces a strong drawing-off effect.

The width of the opening of the slot-shaped nozzle 12 may be relatively larger in the transition area between the roll body and the roll neck of the roll 20, so that larger quantities of air can be drawn off there.

The drawing-off effect is further reinforced by providing the separating element 2 in the end portion 3 with suction ducts 4 between the free end of the end portion 3 and the slot-shaped nozzle 12, wherein each suction duct 4 is directed obliquely upwardly at an acute angle $\beta$ relative to the roll surface.

FIG. 1 of the drawing further shows that the separating element 2 has at least one water discharge channel 26 arranged at a distance behind the slot-shaped nozzle 12. This causes any liquid which is entrained in the air flow and is deposited in the form of drops on the separating element 2 to be conducted away to the side and, thus, it is prevented that liquid flows back into the air flow.

Figure 2:
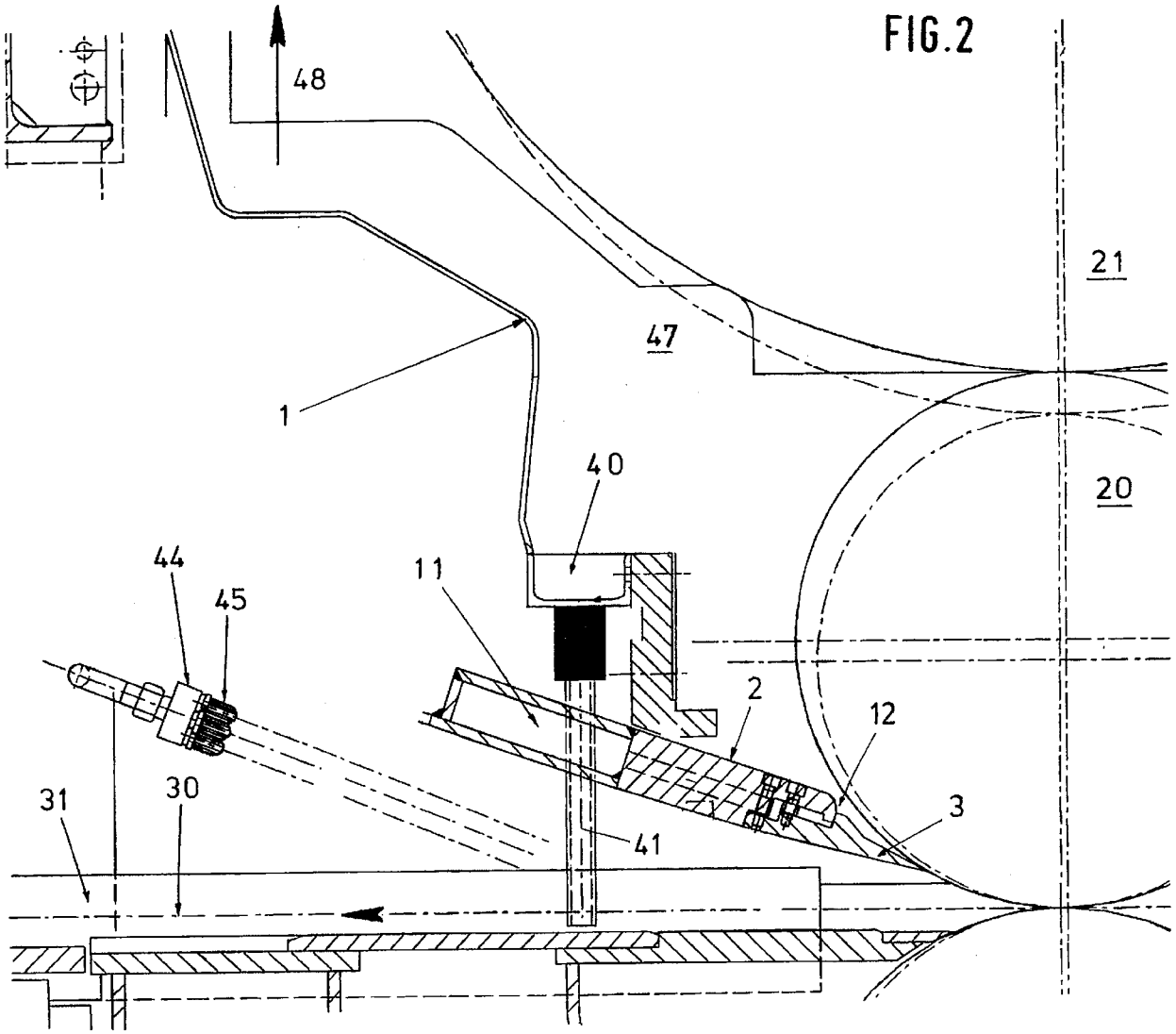
FIG. 2 is a schematic side view of the arrangement according to the present invention for sealing without contact a gap between sealing means and work roll.

FIG. 2 of the drawing shows the arrangement according to the present invention in the assembled state within the separating wall 1. This arrangement results in a very effective combination of blowing-off of the roll 20 and drawing-off of the surface 31 of the rolled material 30 within a relatively narrow space. The separating element 2 is arranged in the lower portion of the separating wall 1, wherein the slot-shaped nozzle 12 is formed between the separating element 2 and the end portion 3 of the separating element 2. The end portion 3 is positioned without contact at a small gap-forming distance and approximately tangentially relative to the surface of the roll 20. The slot-shaped nozzle 12 is connected to the supply duct 11 for compressed air. A discharge channel 40 with lateral discharge pipes 41 is arranged above the separating element 2 in the separating wall 1. The discharge channel 40 has the purpose of collecting liquid droplets which are deposited from the wet flow of the flow channel 25 shown in FIG. 1. In addition, FIG. 2 shows the arrangement of blow nozzles 45 on a nozzle head 44. The blow nozzles 45 have the purpose of blowing entrained liquid, such as water and/or rolling oil, from the edges of the strip of rolled material. The air space 47 between the rolls 20, 21 and the separating wall 1 is connected to a means 48 for drawing off mist.

The arrangement according to the present invention is uncomplicated; the arrangement is very effective because of a configuration which is advantageous to flow conditions; and the arrangement meets the above-mentioned object in an optimum manner.

The invention is not limited by the embodiments described above which are presented as examples only but can be modified in various ways within the scope of protection defined by the appended patent claims.

I claim:

1. An arrangement for sealing without contact a gap between a separating means and a work roll in a runout of a roll stand for rolling rolled material, the work roll having an axis and a surface, the rolled material having a width and a surface, the arrangement comprising a separating element mounted at an end of the separating means, the separating element being arranged so as to extend approximately tangentially relative to the surface of the work roll and at a relatively small distance from the surface of the work roll and from the surface of the rolled material, the separating element having at least one supply duct for compressed air connected to a compressed air source, wherein the supply duct has at an end thereof a slot-shaped nozzle for blowing air in a blowing-out direction, the slot-shaped nozzle having an opening and being located at a small distance from the roll surface and extending along the rolled surface in the direction of the roll axis, the blowing-out direction of the slot-shaped nozzle and a line extending from the nozzle opening perpendicularly relative to the axis of the work roll including an angle of between 0° and 45° in a direction of rotation of the roll, the separating element having at a front side thereof an end portion with a tip and a thickness, the end portion extending approximately tangentially relative to and at a small distance from the roll surface, wherein the thickness of the end portion decreases toward the tip, such that a flow channel is formed between the end portion and the roll surface, wherein a width of the flow channel increases steadily away from the tip in the manner of an injector, and wherein the flow channel extends at least over the width of the rolled material parallel to the axis of the work roll.

2. The arrangement according to claim 1, wherein the angle is 30°.

3. The arrangement according to claim 1, further comprising a guide member mounted on the separating element, the slot-shaped nozzle being defined by the guide member and a step of the end portion of the separating element, the slot-shaped nozzle having a nozzle gap having a width, the guide member being adjustable so as to adjust the width of the nozzle gap.

4. The arrangement according to claim 3, wherein the width of the nozzle gap is adjustable between 0.1 mm and 4 mm.

5. The arrangement according to claim 3, wherein the width of the nozzle gap is 0.2 mm.

6. The arrangement according to claim 3, wherein the work roll has a roll body, a roll neck and a transition area between the roll body and the roll neck, wherein the width of the nozzle gap is greater than 4 mm in the transition area of the work roll.

7. The arrangement according to claim 3, wherein the guide member has a curved flow guide surface extending rearwardly from the nozzle gap.

8. The arrangement according to claim 1, wherein the end portion of the separating element has between the tip and the slot-shaped nozzle at least one suction duct extending through the end portion, the suction duct extending at an acute angle obliquely upwardly relative to the work roll surface.

9. The arrangement according to claim 1, wherein the separating element has at a distance behind the slot-shaped nozzle at least one water discharge channel.

10. The arrangement according to claim 1, further comprising a back-up roll in contact with the work roll, an air space being defined between the work roll, the back-up roll and the separating means, further comprising means for drawing off mist from the air space.

* * * * *